US009033555B2

(12) United States Patent
Childers et al.

(10) Patent No.: US 9,033,555 B2
(45) Date of Patent: May 19, 2015

(54) WRAP-AROUND WINDOW FOR LIGHTING MODULE

(71) Applicant: Phoseon Technology, Inc., Hillsboro, OR (US)

(72) Inventors: Doug Childers, Portland, OR (US); David George Payne, Aloha, OR (US)

(73) Assignee: Phoseon Technology, Inc., Hillsboro, OR (US)

( * ) Notice: Subject to any disclaimer, the term of this patent is extended or adjusted under 35 U.S.C. 154(b) by 0 days.

(21) Appl. No.: 14/198,370

(22) Filed: Mar. 5, 2014

(65) Prior Publication Data

US 2014/0185306 A1 Jul. 3, 2014

Related U.S. Application Data

(63) Continuation-in-part of application No. PCT/US2013/038417, filed on Apr. 26, 2013, which is a continuation of application No. 13/458,813, filed on Apr. 27, 2012, now Pat. No. 8,678,622.

(51) Int. Cl.

| | |
|---|---|
| ***F21K 99/00*** | (2010.01) |
| ***F21V 3/02*** | (2006.01) |
| *F21Y 101/02* | (2006.01) |
| *F21Y 103/00* | (2006.01) |

(52) U.S. Cl.

CPC ... *F21K 9/30* (2013.01); *F21V 3/02* (2013.01); *F21Y 2101/02* (2013.01); *F21Y 2103/003* (2013.01)

(58) Field of Classification Search

USPC ..... 362/311.02, 367, 363, 311.01

See application file for complete search history.

(56) References Cited

U.S. PATENT DOCUMENTS

| | | | |
|---|---|---|---|
| 4,471,414 | A | 9/1984 | Savage, Jr. |
| 5,038,255 | A | 8/1991 | Nishihashi et al. |
| 5,857,767 | A | 1/1999 | Hochstein |
| 5,936,353 | A | 8/1999 | Triner et al. |
| 6,200,134 | B1 | 3/2001 | Kovac et al. |
| 6,411,022 | B1 | 6/2002 | Machida |
| 6,457,823 | B1 | 10/2002 | Cleary et al. |

(Continued)

FOREIGN PATENT DOCUMENTS

| | | | |
|---|---|---|---|
| DE | 19619154 | A1 | 6/1997 |
| DE | 10127171 | A1 | 12/2001 |

(Continued)

OTHER PUBLICATIONS

Data Sheet for G*SiC Technology Super Blue LEDs No. C430-CB290-E1200, manufactured by Opto Semiconductors, May 1, 1999, 8 pages.

(Continued)

*Primary Examiner* — Laura Tso

(74) *Attorney, Agent, or Firm* — Alleman Hall McCoy Russell & Tuttle LLP

(57) ABSTRACT

A lighting module may comprise a housing, a window frame mounted at a front side of the housing, a window mounted at a front plane of the window frame, the window comprising a window front face spanning a front plane length and first and second window sidewalls extending rearwards from first and second edges of the window front face, and an array of light-emitting elements within the housing, the array aligned with and emitting light through a window front plane and through the first and second window sidewalls.

19 Claims, 8 Drawing Sheets

(56) References Cited

U.S. PATENT DOCUMENTS

| | | | | |
|---|---|---|---|---|
| 6,501,084 | B1 | 12/2002 | Sakai et al. | |
| 6,517,218 | B2 | 2/2003 | Hochstein | |
| 6,683,421 | B1 | 1/2004 | Kennedy et al. | |
| 6,692,250 | B1 | 2/2004 | Decaudin et al. | |
| 7,118,251 | B1 * | 10/2006 | Chambers et al. | 362/311.02 |
| 7,976,181 | B2 | 7/2011 | Kelly et al. | |
| 8,678,622 | B2 * | 3/2014 | Childers et al. | 362/311.02 |
| 2001/0046652 | A1 | 11/2001 | Ostler et al. | |
| 2002/0187454 | A1 | 12/2002 | Melikechi et al. | |
| 2003/0043582 | A1 | 3/2003 | Chan et al. | |
| 2003/0081096 | A1 | 5/2003 | Young | |
| 2005/0083323 | A1 | 4/2005 | Suzuki et al. | |
| 2012/0099326 | A1 | 4/2012 | Hammond et al. | |
| 2013/0039054 | A1 * | 2/2013 | Yang et al. | 362/234 |

FOREIGN PATENT DOCUMENTS

| | | | |
|---|---|---|---|
| EP | 0879582 | A1 | 11/1998 |
| EP | 1158761 | A1 | 11/2001 |
| EP | 1599340 | B1 | 9/2007 |
| EP | 2045516 | A1 | 4/2009 |
| JP | 2004228263 | A | 8/2004 |
| WO | 9507731 | A1 | 3/1995 |
| WO | 0059671 | A1 | 10/2000 |
| WO | 0067048 | A2 | 11/2000 |
| WO | 0211640 | A2 | 2/2002 |
| WO | 0213231 | A2 | 2/2002 |
| WO | 03023875 | A2 | 3/2003 |
| WO | 2011097694 | A1 | 8/2011 |
| WO | 2011011934 | A2 | 9/2011 |

OTHER PUBLICATIONS

Data Sheet for 5.0 mm Blue Series LEDs No. LNG992CFB, manufactured by the Panasonic Corporation, Mar. 2001, 1 page.

Data Sheet for 3.0 mm Blue Series LEDs No. LNG997CKB, manufactured by the Panasonic Corporation, Mar. 2001, 1 page.

Data Sheet for G*SiC Technology Ultraviolet LEDs No. C395-MB290-E0400, manufactured by Cree, Inc., 2 pages.

Korean Intellectual Property Office, International Search Report and Written Opinion of PCT/US2013/038417, WIPO, Aug. 28, 2013, 9 pages.

* cited by examiner

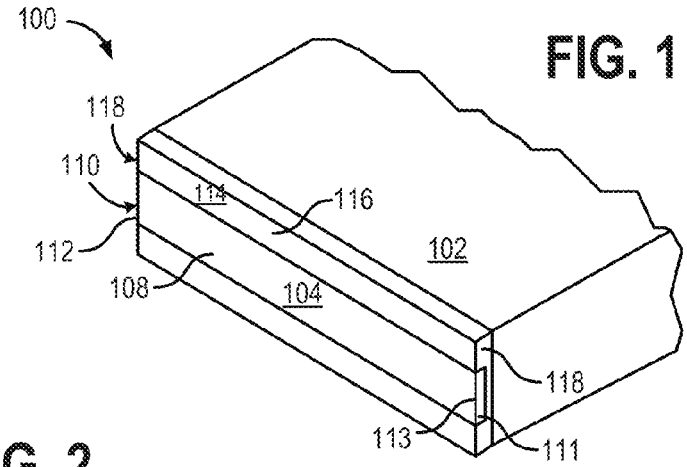
FIG. 1
FIG. 2
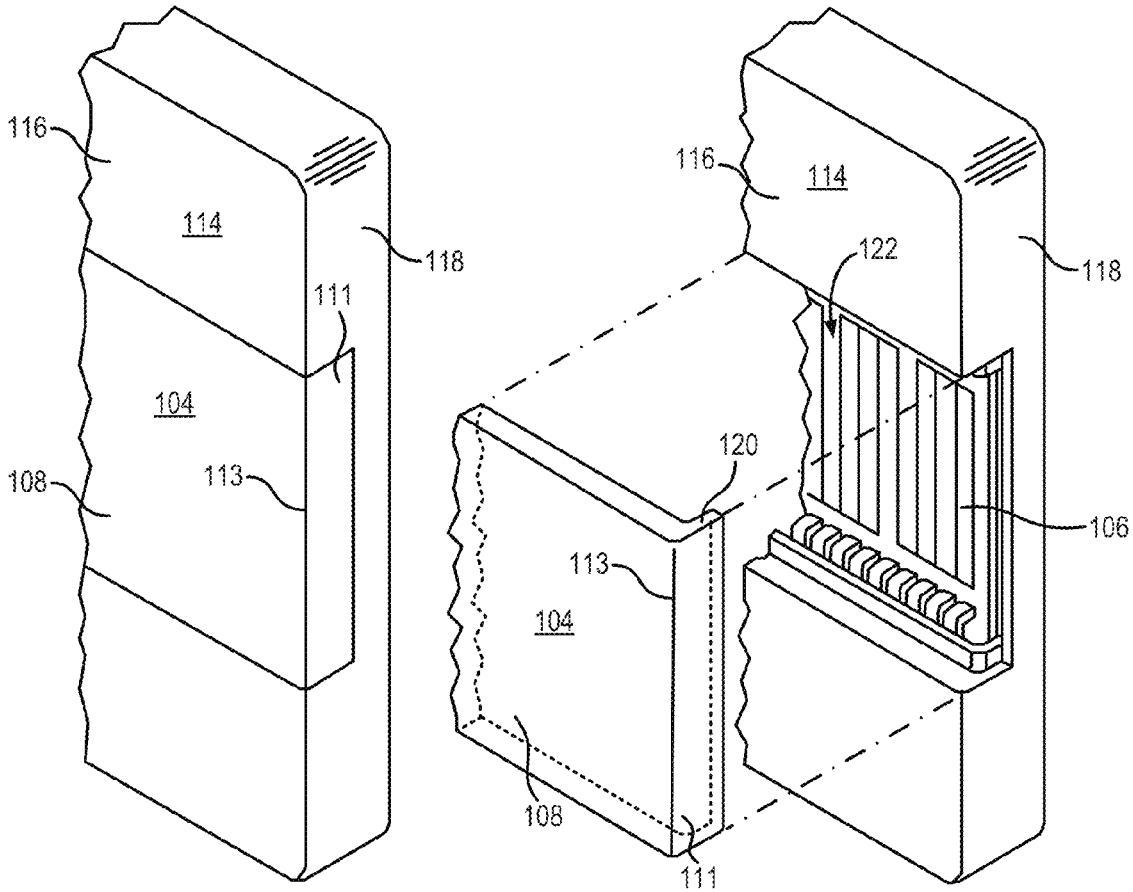
FIG. 3

WRAP-AROUND WINDOW FOR LIGHTING MODULE

RELATED APPLICATIONS

The present application is a continuation-in-part of International Patent Application Serial No. PCT/US2013/038417, filed on Apr. 26, 2013 and entitled WRAP-AROUND WINDOW FOR LIGHTING MODULE, which claims priority to U.S. patent application Ser. No. 13/458,813, filed on Apr. 27, 2012 and entitled WRAP-AROUND WINDOW FOR LIGHTING MODULE, the entirety of both of which are hereby incorporated herein by reference for all intents and purposes.

BACKGROUND

Solid-state light emitters, such as light-emitting diodes (LEDs) and laser diodes, have several advantages over using more traditional arc lamps during curing processes, such as ultraviolet (UV) curing processes. Solid-state light emitters generally use less power, generate less heat, produce a higher quality cure, and have higher reliability than the traditional arc lamps. Some modifications increase the effectiveness and efficiency of the solid-state light emitters even further. Conventional lighting modules employing solid-state light emitters have a housing within which light-emitting elements, such as LEDs and laser diodes, are positioned. Light is irradiated from the solid-state light emitters through a flat front window of the housing onto a substrate, for example, to cure a light-activated material on the surface of the substrate.

The inventors herein have recognized potential issues with the above approach. Solid-state light emitters such as LED's, and other types of lighting modules may be characterized as exhibiting a Lambertian or near-Lambertian emission pattern. Accordingly, one challenge with lighting modules employing solid-state light emitters is providing a uniform irradiance of light across an entire target object or surface. In particular, curing of large two-dimensional surfaces may require manufacture of large lighting modules that are costly and cumbersome, or may require combining multiple lighting modules to provide irradiance over the target surface area. Namely, irradiance uniformity is poor near edges of emission patterns of individual lighting modules and at junctions between multiple lighting modules. Furthermore, irradiating light from lighting modules through flat front windows, wherein light is emitted from an array of light-emitting elements only through a front plane of the lighting module, can further contribute to poor irradiance uniformity near the edges of the lighting module. Non-uniformities in irradiance can result in curing non-uniformities over a substrate surface, and can thereby reduce the efficiency of the curing process.

One approach that at least partially addresses the aforementioned issues includes a lighting module, comprising a window casing, a window mounted at a window casing front face, wherein a window front face spans a length of the window casing front face, and the window front face is flush with the window casing front face, and an array of light-emitting elements positioned behind the window casing to emit light through the window.

In another embodiment, a method of irradiating light may include irradiating light from an array of lighting modules, each of the lighting modules comprising a window casing, a window mounted at a window casing front side, wherein the window comprises a window front face spanning a front plane length of the window casing front side, and wherein the window front face is flush and parallel with the window casing front side, first and second window sidewalls extending rearwards from left and right edges of the window front face, respectively, and an array of light-emitting elements positioned within the window casing to emit light through the window front plane and through the first and second window sidewalls.

In another embodiment, a lighting system may include a power supply, a cooling subsystem, a light-emitting subsystem comprising a window casing, a window frame mounted at a window casing front side, a window mounted at a front plane of the window frame, the window comprising a window front face spanning a front plane length, wherein the window front face is flush with a window frame front side, and first and second window sidewalls extending rearwards from first and second edges of the window front face at first and second angles, respectively, a linear array of light-emitting elements within the window casing, the linear array aligned with and emitting light through a window front plane and through the first and second window sidewalls, wherein window sidewalls at the first and second edges of the window front face are aligned flush with window casing sidewalls, the window sidewalls extending perpendicularly back from the front plane, the linear array of light-emitting elements comprises a middle portion in between two end portions, and a controller, including instructions executable to supply a first, larger, drive current to each of a plurality of light-emitting elements in the middle portion, and supply a second, smaller, drive current to each of a plurality of light-emitting elements in the two end portions.

It will be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 1 shows a front perspective view of a lighting module.

FIG. 2 shows a partial front perspective view of the window frame and window of the lighting module of FIG. 1.

FIG. 3 shows a partial exploded view of the window frame and window of the lighting module of FIG. 1.

DETAILED DESCRIPTION

Figure 4:
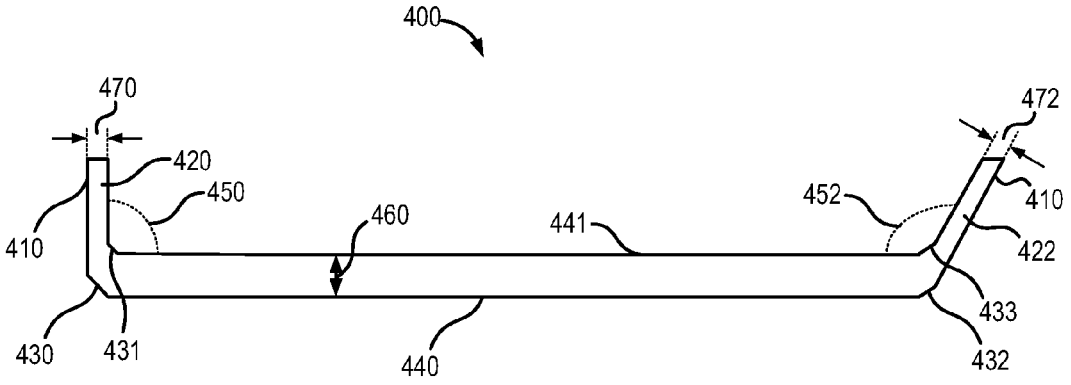
FIGS. 4-6 are aerial views of example windows for a lighting module.
Figure 5:
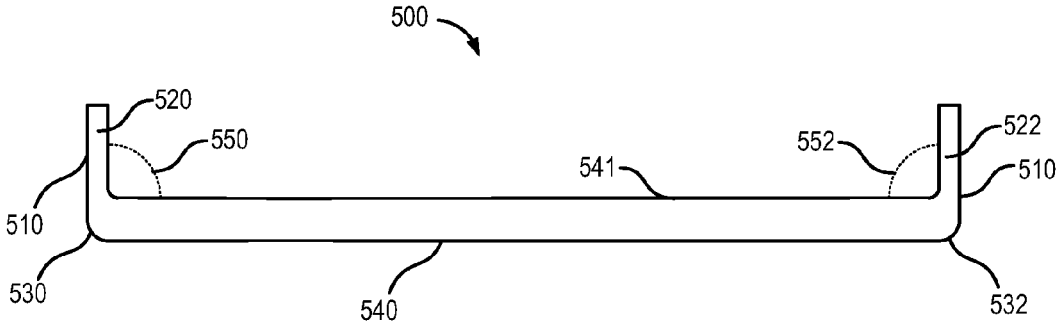
Figure 6:
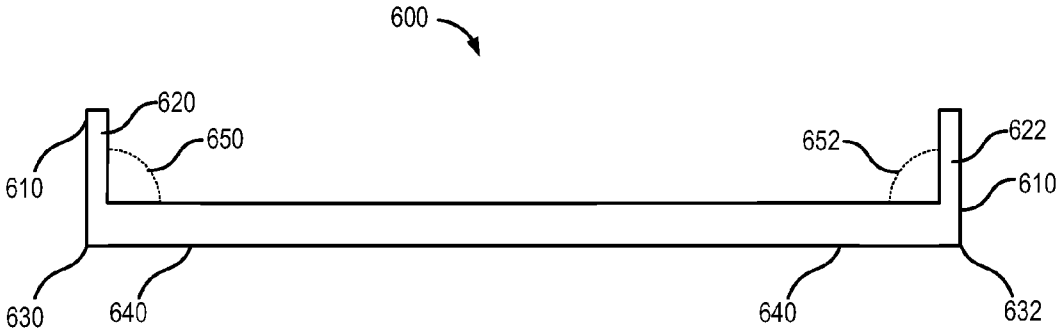
Figure 7:
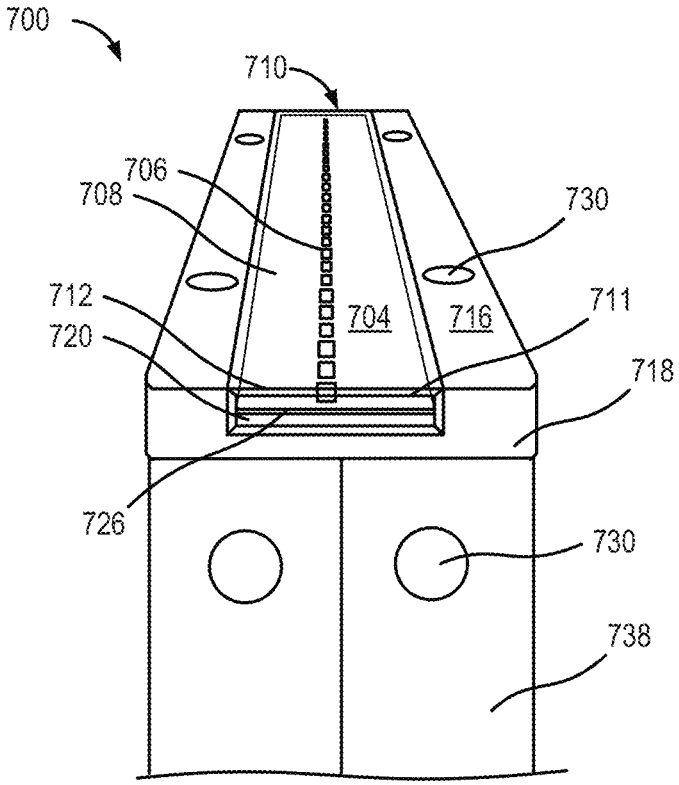
FIG. 7 is a partial side perspective view of a lighting module.
Figure 8:
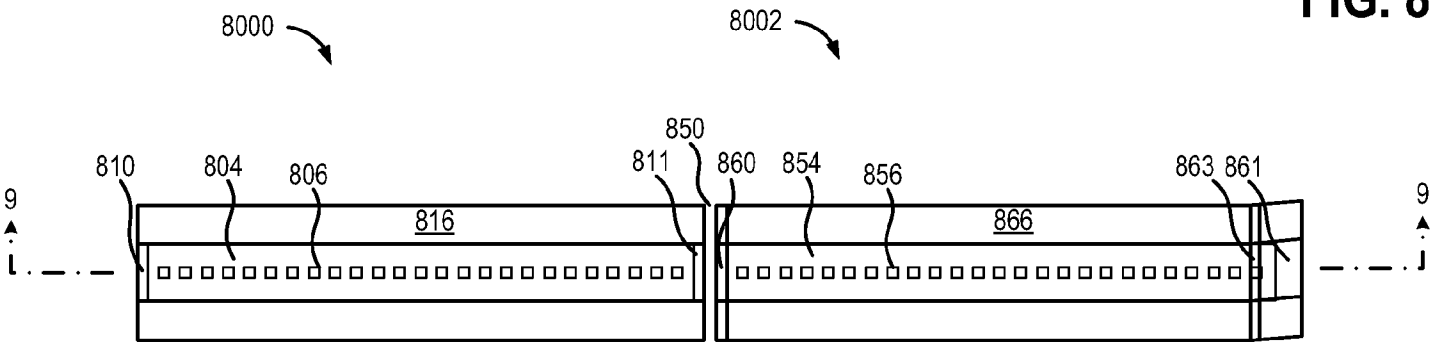
FIG. 8 is a front view of two lighting modules positioned side by side.
Figure 9:
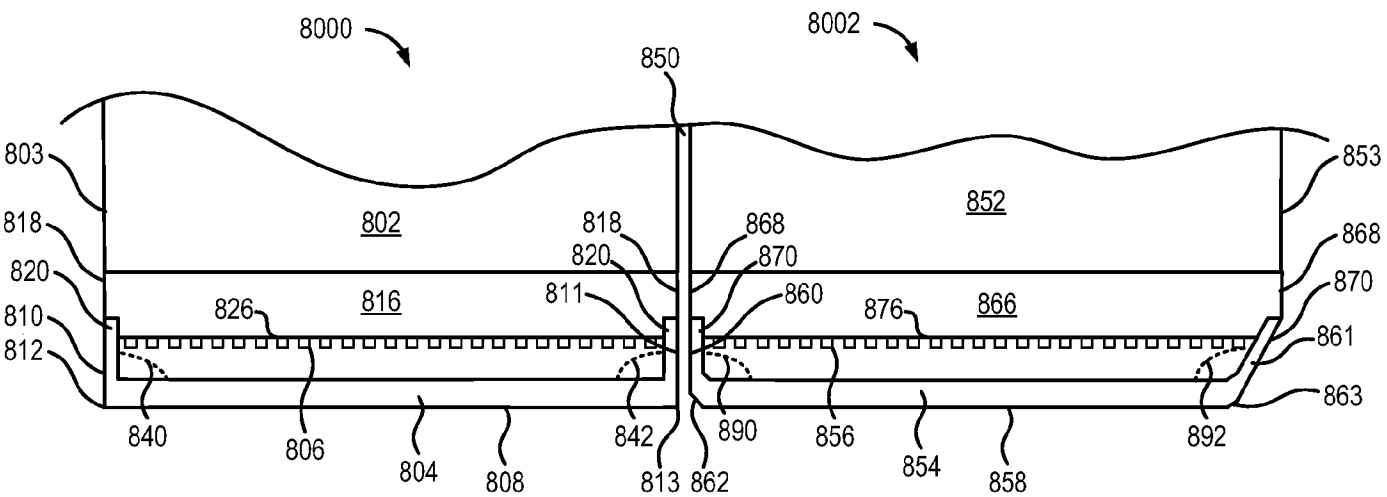
FIG. 9 is a partial aerial cross-sectional view of the two lighting modules of FIG. 8.
Figure 10:
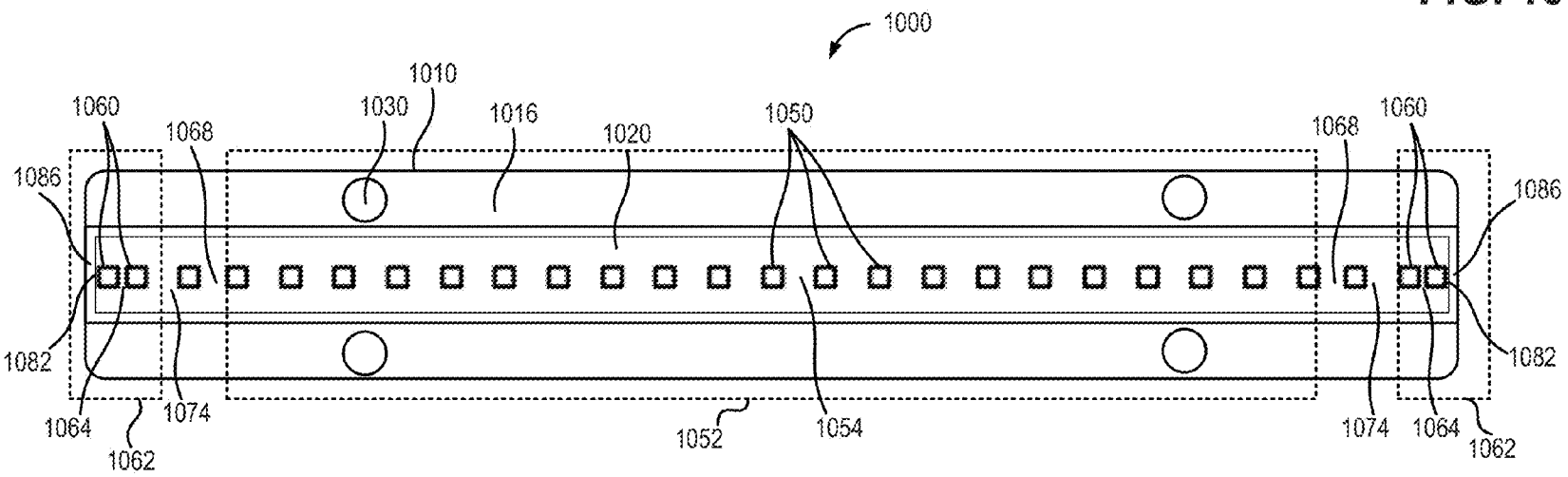
FIG. 10 is a front view of an example lighting module.
Figure 11:
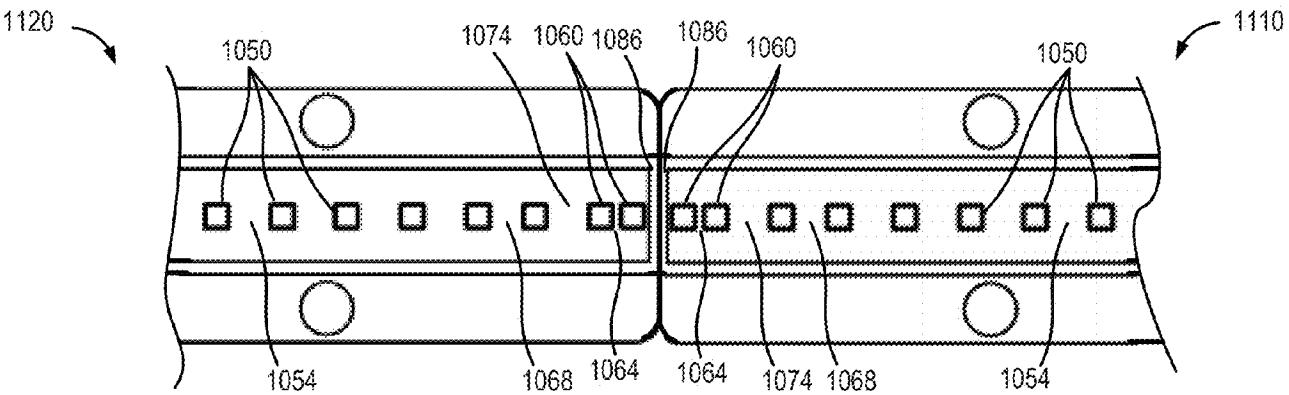
FIG. 11 is a partial front view of two of the example lighting modules of FIG. 10 positioned side by side.
Figure 12:
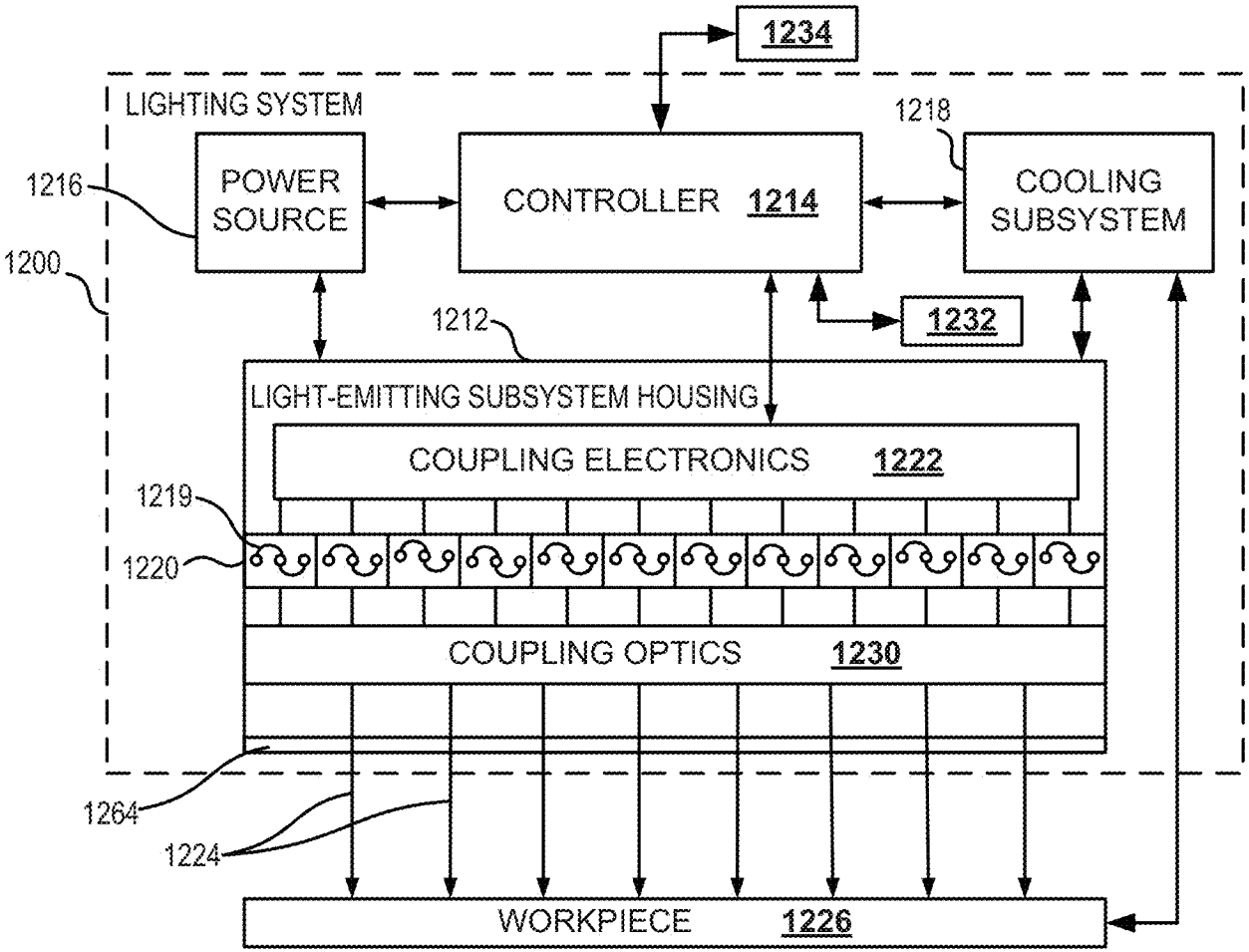
FIG. 12 is a schematic illustrating an example of a lighting system.
Figure 13:
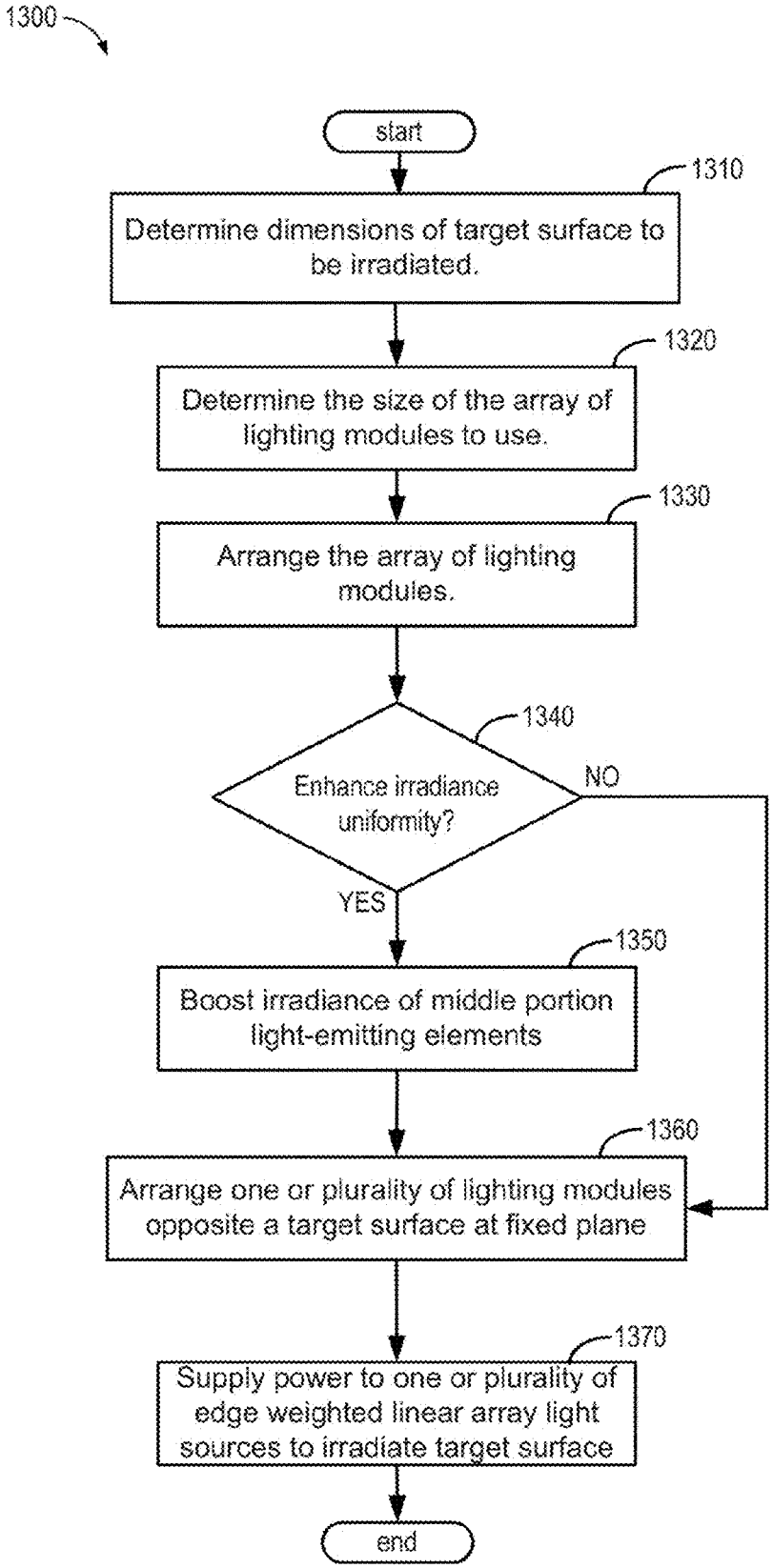
FIG. 13 is an example flow chart for a method of using a lighting module.
Figure 14:
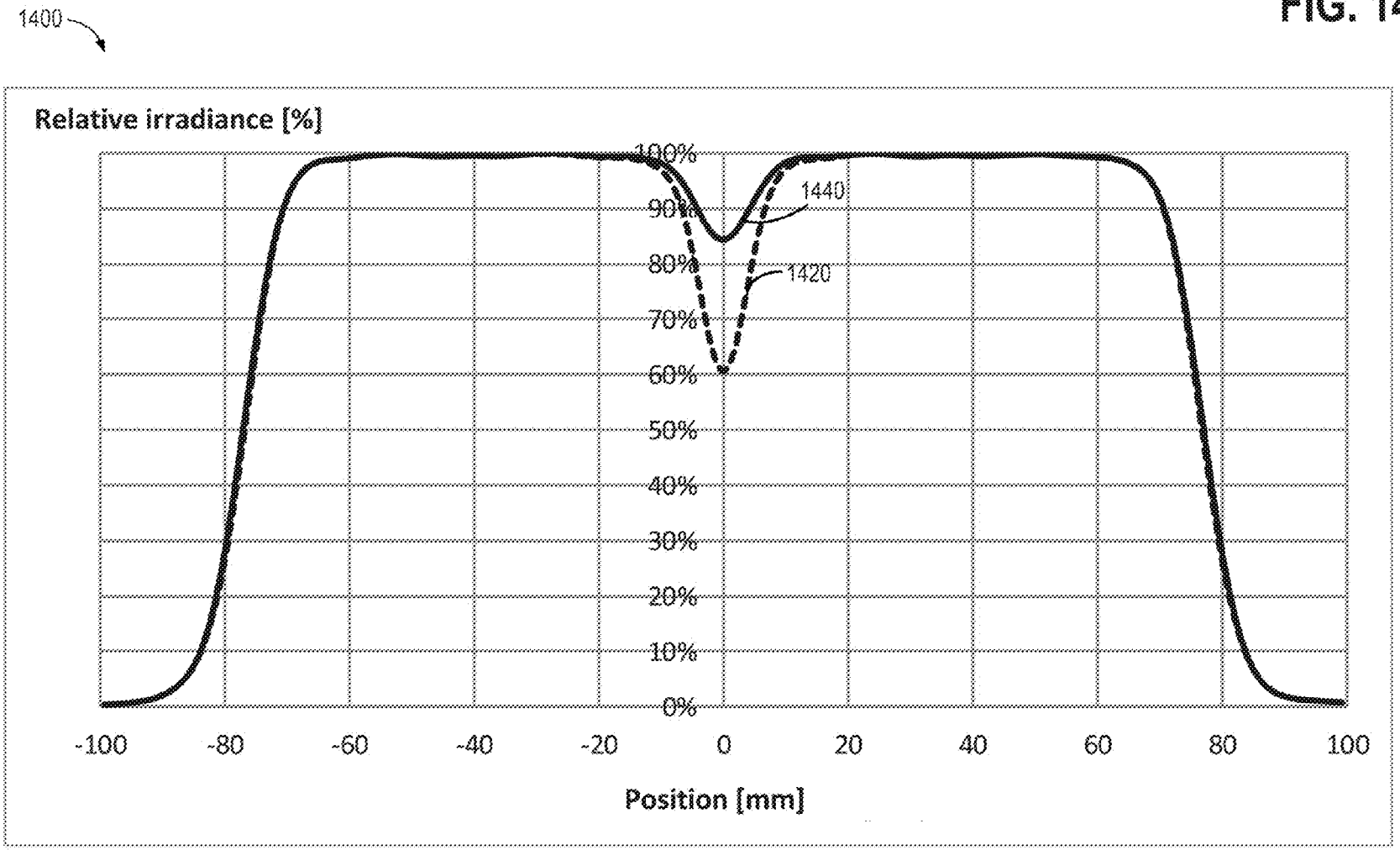
FIG. 14 is an example irradiance plot for two side by side lighting modules.

The present description relates to a lighting module, method of irradiating light from a lighting module, and a lighting system for use in the manufacture of coatings, inks, adhesives, and other curable workpieces. FIGS. 1-3 illustrate an example of a lighting module comprising a window frame mounted at a front side of a housing and a window frame mounted in a front plane of the window frame. The window includes a front face and first and second window sidewalls extending rearwards from the window front face. FIGS. 4-6 illustrate examples of lighting module windows with various edge and sidewall geometries that may be used to enhance the uniformity of irradiated light. An example lighting module including a window mounted in a window frame is shown in FIG. 7. In particular, a window sidewall flange is shown extending rearward from the window front face beyond an array of light-emitting elements. FIGS. 8-9 illustrate a pair of lighting modules positioned side by side in a lengthwise direction. FIG. 10 shows a frontal view of an example lighting module comprising a linear array of edge weighted light-emitting elements, while FIG. 11 illustrates an example of a partial frontal view of two lighting modules comprising edge weighted linear arrays of light-emitting elements arranged side by side. Edge-weighting the spacing of the linear array can enhance the uniformity of irradiated light, particularly near the edges of the array, as compared to a uniformly spaced linear array of light-emitting elements. A schematic of an example lighting system is depicted in FIG. 12 and a flow chart for a method of irradiating light from an example lighting module is shown in FIG. 13. FIG. 14 is an example plot comparing the irradiance from two side by side lighting modules with and without wrap around windows with transparent sidewalls.

Referring now to FIGS. 1-3, a lighting module 100 may comprise a housing 102, a window frame 114 mounted at a front side of the housing 102, and a window 104 mounted at a front plane of the window frame 114. In one example, the housing 102 may act as a case or window casing for the window 104. In another example, a separate structure can act as a case or window casing for the window 104. Furthermore, the window frame 114 may be integrated into the window casing such that the window casing comprises the window frame 114. The window 104 may comprise a front window front face 108 spanning a front plane length and first and second window sidewalls 110 and 111 extending rearwards from the first and second widthwise window edges 112 and 113 of the window front face 108. The window frame 114 may comprise a window frame front face 116 and window frame sidewalls 118. As shown in FIGS. 1-2, second window sidewall 111 may extend rearward perpendicularly from window front face 108. Furthermore edges 112 and 113 may be sharp and right-angled. Housing 102 may contain other components of lighting module 100 such as a power supply, controller, cooling subsystem components such as fans and channels for conveying cooling fluid, and electronics and wiring.

Window front face 108 may be flush and parallel with window frame front face 116. Furthermore, the window casing front face may be flush and parallel with window front face 108 such that the window casing front face and the window front face form a coplanar surface wherein the adjoining edges of the window front face and the window casing front face come together and flushly abut so that there are no substantial ridges or gaps therebetween. In other words, the window front face and the window casing front face are aligned to form a smooth, flushly aligned surface. In the case where the window front face and the window casing front face are flat, planar surfaces, when flushly aligned, window front face and the window casing front face form a flat, coplanar surface. In the case where the window front face and the window casing front face are curved (e.g., convex or concave) surfaces, when flushly aligned, window front face and the window casing front face form a continuous curved surface, with no substantial ridges or gaps therebetween. Further still, second window sidewall 111 may be flush with and parallel with window frame sidewall 118. Further still, left and right window casing sidewalls may be flush with and parallel with left and right window sidewalls, respectively. In other words, the window casing sidewalls and the window sidewalls may form a coplanar surface wherein the adjoining edges of the window sidewalls and the window casing sidewalls come together and flushly abut so that there are no substantial ridges or gaps therebetween. In other words, the window front face and the window casing front face are aligned to form a smooth, flushly aligned surface. In the case where the window sidewalls and the window casing sidewalls are flat, planar surfaces, when flushly aligned, window sidewalls and the window casing sidewalls form a flat planar surface. In the case where the window sidewalls and the window casing sidewalls are curved (e.g., convex or concave) surfaces, when flushly aligned, window sidewalls and the window casing sidewalls form a continuous curved surface, with no substantial ridges or gaps therebetween.

First and second window sidewalls may further comprise window flanges 120, the window flanges extending rearwards beyond the array of light-emitting elements 106. For example, as shown in FIG. 3, when window 104 is mounted to window frame 114 via opening 122, the rear edge of flange 120 extends beyond the array of light-emitting elements 106 in rearward direction. In this manner, light emitted from the array of light-emitting elements 106 may be irradiated through the window front face 108 and through first and second window sidewalls 110 and 111. Because light emitted from the array of light-emitting elements 106 is emitted through the first and second window sidewalls 110 and 111, the uniformity of irradiated light, particularly at the edges of lighting module 100 near first and second widthwise edges 112 and 113, may be enhanced as compared to lighting modules emitting light through only a flat front plane of a window. Accordingly, the array of light-emitting elements 106 may be positioned within and aligned with the housing 102 to emit light through the window front face 108 as well as the first and second window sidewalls 110 and 111. Furthermore, the array of light-emitting elements 106 may emit light through the window 104 toward a substrate comprising a light-curable material (not shown in FIGS. 1-3).

Turning now to FIG. 14, it illustrates a plot 1400 showing the relative irradiance data as a function of position from two side by side lighting modules. The example lighting modules represented in plot 1400 are each 100 mm wide, wherein light is irradiated from the lighting modules between position values of −100 mm to 100 mm corresponding to the overall widths of the side by side lighting modules. In a first case 1440, both side by side lighting modules comprise a window having a transparent sidewall at the edge located at a position of 0 mm such that light emitted from an array of light-emitting elements may be transmitted through the transparent sidewall and through a window front face. In a second case 1420, both side by side lighting modules comprise a flat window without a transparent sidewall, wherein light emitted from the array of light-emitting elements may be transmitted through a window front face only. As shown by the data corresponding to cases 1440 and 1420, the side by side lighting modules having transparent sidewalls at 0 mm achieve enhanced uniformity in irradiation of light near and across the edges of side by side lighting modules.

Returning to FIG. 1, the window front face 108 and the first and second window sidewalls 110 and 111 can be positioned at an angle with respect to each other or may be shaped in any other way, such as a rounded or beveled surface or any other suitable shaped (non-flat) contour. For example, the window front face 108 and the first and second window sidewalls 110 and 111 of the window 104 shown in FIGS. 1-3 are angled at approximately 90° with respect to each other. However, the window front face 108 and the first and second window sidewalls 110 and 111 can be angled at any other suitable angle either greater than or less than 90° with respect to each other in other lighting modules 100. By varying the degree of the angle between the window front face 108 and the first and second window sidewalls 110 and 111 of the window 104, the direction and uniformity of distribution of the light emitted from the lighting module 100 can be changed as it is emitted toward the substrate and light-activated material combination.

The window front face 108 and the second window sidewall 110 of the window 104 intersect each other at edges 112 and 113 in the examples shown in FIGS. 1-3. In these lighting modules 100, the edges 112 and 113 define a sharp corner that forms an approximately 90° angle. The edges 112 and 113 can also be rounded, beveled, or any other suitable shape or contour. The shape and contour of edges 112 and 113 are not dependent upon, although they can be related to, the angle at which the window front face 108 and the first and second window sidewalls 110 and 111 of the window 104 are angled. The examples shown in FIGS. 1-3 show a window front face 108 and first and second window sidewalls 110 and 111 of the window 104 that are angled at approximately 90° with respect to each other and define edges 112 and 113 where they intersect that are corner that approximately form 90° angles respectively. In other examples, the window front face 108 and the first and second window sidewalls 110 and 111 of the window 104 can be angled at greater than 90° with respect to each other and can also have an edge that is a sharp corner, or is beveled, rounded, or the like. Any suitable combination of angles between the window front face 108 and the first and second window sidewalls 110 and 111 of the window, and shapes and contours of the edges 112 and 113 of the window may be used.

Further, the window 104 shown in FIGS. 1-3 is generally U-shaped and "wraps" or otherwise extends around a portion of the housing 102 of the lighting module 100. This wrap-around window structure permits light to be emitted through the window front face 108 and the first and second window sidewalls 110 and 111 away from the lighting module 100; namely light may be emitted in directions away from the window front face 108 of the window 104 and away from both first and second window sidewalls 110 and 111 of the window 104. The first and second window sidewalls 110 and 111 of the window 104 can both be formed at the same angle and shape with respect to the window front face 108 of the window 104 or may be formed at different angles and shapes with respect to the window front face 108 of the window 104.

FIG. 1 shows a front perspective view of a lighting module 100 that has a housing 102, a window frame 114, and a window 104. The window frame 114 is attached to and extends away from the housing 102 and may or may not be removable from the housing 102. The window frame 114 has a window frame front face 116 and window frame sidewalls 118 that are coincident with the window front face 108 and the first and second window sidewalls 110 and 111 of the window 104. While the lighting module 100 shown in FIGS. 1-3 includes a window frame 114, some other lighting modules do not include a frame. In yet other lighting modules, the window frame forms an integral part of the lighting module housing. FIG. 1 shows the window front face 108 of the window 104 extending along at least a portion of the window frame front face 116, and shows the second window sidewall 111 of the window 104 extending along some portion of the window frame sidewall 118. The window front face 108 of the window 104 shown in FIG. 1 has a length that extends or spans along the entire length of the window frame front face 116 and a height that extends along only a portion of the height of the window frame front face 116. The window front face 108 in FIG. 1 is positioned approximately mid-way along the height of the window frame front face 116, although the window front face 108 can be positioned in any other suitable position along the height of the window frame front face in other examples.

FIG. 2 shows a portion of one side of the window frame 114 and the window 104 shown in FIG. 1. The second window sidewall 111 of the window 104 defines a flange 120 (see FIG. 3) that wraps-around a portion of window frame sidewall 118. Although the second window sidewall 111 of the window 104 extends along approximately half of the window frame sidewall 118 in the lighting module 100 shown in FIG. 2, the second window sidewall 111 may extend along any other desired portion of the window frame sidewall in other examples. The second window sidewall 111 of the window 104 may also be the same height as the window front face 108 in the lighting module 100 shown in FIG. 2. In other lighting modules, the first and second window sidewalls 110 and 111 of the window 104 may be a different height or may vary in shape or contour to the window front face 108.

FIG. 3 shows a partial exploded view of the portion of the side of the window frame 114 and window 104 shown in FIG. 2. FIG. 3 shows that the window frame 114 includes an opening 122 into which the window 104 may be fitted. Opening 122 may span the length of the front plane of window frame 114, and may have a height profile matching that of window front face 108 and first and second window sidewalls 110 and 111. In this lighting module 100, the opening 122 of the window frame 114 is shaped so that the window 104 may be snugly fitted into the opening 122 so that the window front face 108 and the window frame front face 116 may form a relatively smooth surface along the same plane with each other, and so that the second window sidewall 111 of the window 104 and the sidewall 118 of the window frame 114 also may form a relatively smooth surface along the same plane with each other. In other lighting modules, the window front face 108 and/or the second window sidewall 111 of the window 104 can be raised, inset, concave, convex, or some combination thereof with respect to the window front face 108 and/or sidewall 118 of the window frame 114. Concave and convex window surfaces may incorporate various optical qualities for directing the light emitted from the lighting module in a particular direction or with a desired angle, depending on the window and lighting module construction. As an example, window 104 may be a convex cylindrical lens or a Fresnel lens for focusing emitted light from the array of light-emitting elements on a linear substrate such as an optical fiber.

FIG. 3 also shows the array of light-emitting elements 106 that are positioned within the housing 102. The array of light-emitting elements 106 may emit light through the window front face 108 and the first and/or second window sidewalls 110 and 111 of the lighting module 100. For example, a method of curing may include emitting light from the array of light-emitting elements 106 that are positioned within the housing 102 that includes a window 104 having a window front face 108 and first and second window sidewalls 110 and 111. A portion of the emitted light may be received through the window front face and a second portion of the emitted light may be received through the first and second window sidewalls 110 and 111 of the window 104.

As a further example, multiple lighting modules may be stacked together in side by side arrangement horizontally, vertically, or any combination thereof. This type of lighting module side by side stacked arrangement can be customized to the dimensions of the substrate that is being cured. More specifically, the number of stacked lighting modules or the array size of stacked lighting modules may be determined according to the surface area of the substrate to be irradiated. Owing at least partially to the wrap-around window structure, the light emitted from the array of light-emitting elements along the gap between the windows of adjacently stacked lighting modules may remain generally uniform with the remaining light emitted from the array of light-emitting elements. Accordingly, the stacked lighting modules with the disclosed wrap-around window structures may promote and enhance a uniform emission of light along and in the vicinity of the edges of the windows of each lighting module.

As discussed above, some lighting modules may have wrap around windows that may wrap around or otherwise extend along two or more sidewalls of some portion of the housing of the lighting module, such as via an optional window frame. In the stacked lighting module arrangement, the lighting module positioned within a center portion of the stacked arrangement or array and bordering another lighting module on all sides may include windows having first and second window sidewalls that are the same shape and contour. In other examples, where lighting modules are positioned along an end or the perimeter of the stacked arrangement or array and having at least one window sidewall exposed rather than positioned next to the window sidewall of another lighting module, the first and second window sidewalls may be the same shape and contour or may be different shapes and contours.

For example, a lighting module positioned along the perimeter of a stacked lighting module arrangement may have first and second opposing sidewalls. The first window sidewall may be positioned adjacent to a window sidewall of a neighboring lighting module in the stacked arrangement and may be angled approximately 90° with respect to the window front face. The second window sidewall of the window that is not positioned adjacent to a sidewall of another neighboring lighting module in the stacked configuration may be angled at a greater than 90° angle with respect to the window front face and can also have a rounded or beveled edge. In this manner, the uniformity of light emitted away from the lighting module positioned along the perimeter of a stacked lighting module arrangement may have an enhanced uniformity of distribution.

Turning now to FIGS. 4-6, they illustrate aerial views of example lighting module windows. Window 400 comprises a substrate-facing front face 440 and a light-emitting element array facing front face 441. A window front face thickness 460 may be defined by the distance between substrate-facing and light-emitting element facing front faces 440 and 441, respectively. Widthwise edges 430 and 432 of the substrate-facing front face 440 may be beveled. In other examples the widthwise edges may be rounded (e.g., FIG. 5) or sharp and right angled (e.g., FIG. 6). Corresponding widthwise edges 431 and 433 of light-emitting element array facing front face 441 may also be beveled, rounded, sharp and right-angled, or another non-flat shape. First and second window sidewalls 420 and 422 may extend rearwards from widthwise edges 430 and 432, respectively, rearwards at an angle from the front face of the window. For example, first and second window sidewalls 420 and 422 may extend rearwards from the front face of the window at first and second angles 450 and 452, respectively. As an example, first angle 450 may be 90° so that first window sidewall 420 is perpendicular to the window front face, and second angle 452 may be greater than 90° so that second window sidewall 422 extends rearward in an oblique direction from window front face. First and second window sidewall thicknesses 470 and 472, respectively, may be thinner than window front face thickness 460, or they may be the same as window front face thickness 460. The first and second window sidewall thicknesses, the window front face thickness 460, the first and second angles, and the shape and geometry of the widthwise edges 430, 431, 432, and 433 may be designed and determined to modify the uniformity of irradiated light from the lighting module, particularly at the widthwise edges of the lighting module. For example, reducing the first and/or second window sidewall thicknesses may enhance the uniformity of light near edges and across lighting modules positioned side by side. As a further example, increasing the thickness of the window front face may enhance the uniformity of light near edges and across lighting modules positioned side by side. As a further example, increasing the thickness of the window front face may reduce the irradiance of light transmitted therethrough. Furthermore, first and second window sidewalls 420 and 422, respectively, each comprise flange 410 that extends rearward for attaching via opening 122 to window frame 114. As an example, the window flanges 410 may friction fit snugly or snap fit into the base of opening 122 of window frame 114.

As another example, window 500 comprises substrate-facing front face 540 and light-emitting element array facing front face 541. Window 500 is an example lighting module window having rounded first and second widthwise edges 530 and 532. As illustrated in FIG. 5, first and second angles 550 and 552 are approximately 90°, however in other examples first and second angles 550 and 552 may be different from 90°. First and second window sidewalls 520 and 522 extend rearward from substrate-facing window front face 540 and each comprise window flanges 510.

As another example, window 600 comprises substrate-facing front face 640 and light-emitting element array facing front face 641. Window 600 is an example lighting module window having sharp right-angled first and second widthwise edges 630 and 632. As illustrated in FIG. 6, first and second angles 650 and 652 are approximately 90°, however in other examples first and second angles 650 and 652 may be different from 90°. First and second window sidewalls 620 and 622 extend rearward from substrate-facing window front face 640 and each comprise window flanges 610.

FIG. 7 illustrates a partial side perspective view of another example lighting module 700 comprising window frame 716, window 704, fasteners 730 and linear array of light-emitting elements 706. Window 704 comprises window front face 708 and window sidewalls 710 and 711, wherein window front face 708 meets window sidewalls 710 and 711 at window edges 712, respectively. Both window front face 708 and window sidewalls 710 and 711 may be transparent. Furthermore, window sidewalls 710 and 711 may each comprise a window flange 720 extending rearward from window front face beyond a surface 726 where the array of light-emitting elements 106 is positioned. As an example, the surface 726 may be the printed circuit board upon which the array light-emitting elements 106 is mounted.

Accordingly, a portion of light irradiated from light-emitting elements located adjacent to and near window sidewalls 710 and 711 may be irradiated through window sidewalls 710 and 711, respectively. Irradiation of light through window sidewalls 710 and 711 of lighting module may thereby reduce non-uniformities in irradiated light across multiple lighting modules arranged adjacently side by side as compared to conventional lighting modules arranged side by side. Window sidewalls 710 and 711 may be aligned flush with the sidewalls 710 of window frame 716 and housing sidewalls 738 so that lighting modules can be positioned side by side in a flush or near-flush arrangement wherein a gap between the side by side lighting modules is reduced. To this end, fasteners 730 mounted in housing sidewalls 738 may also be recessed from the plane of housing sidewalls 738 when fully secured. As previously described, aligning the window sidewalls 710 and 711 to be flush with the housing sidewalls 738 may reduce spacing between and may aid in maintaining continuity and uniformity of irradiated light across multiple lighting modules arranged side by side.

FIGS. 8 and 9 illustrate two lighting modules arranged side by side. Turning now to FIG. 8 it illustrates a frontal view of two lighting modules 8000 and 8002 positioned side by side wherein a second window sidewall 811 of window 804 of lighting module 8000 is adjacent to first window sidewall 860 of window 854 of lighting module 8002. A narrow gap 850 may be present between lighting modules 8000 and 8002. Lighting modules 8000 and 8002 may each comprise an array of light-emitting elements 806 and 856 respectively, and a window frame 816 and 866 respectively. Furthermore, windows 804 and 854 each may comprise first window sidewalls 810 and 860 respectively, second window sidewalls 811 and 861 respectively.

Turning now to FIG. 9, it illustrates a partial cross-sectional view of lighting modules 8000 and 8002 taken along the section 9 indicated in FIG. 8. Lighting modules 8000 and 8002 may each comprise housings 802 and 852 respectively, to which window frames 816 and 866 respectively are mounted at the front sides of the housings. The arrays of light-emitting elements 806 and 856 are each respectively contained within the window frames 816 and 866 of housings 802 and 852. Furthermore, windows 804 and 854 may each be snugly fit into the window frames 816 and 866 via their respective window flanges 820 and 870. Although not shown in FIG. 9, housings 802 and 852 may contain other components of lighting modules 8000 and 8002 respectively, such as a power supply, controller, cooling subsystem components such as fans and channels for conveying cooling fluid, and electronics and wiring.

Windows 804 and 854 each comprise a window front face 808 and 858 respectively. The first and second window sidewalls extend rearwards from the window front faces. For example, in lighting module 8000, first and second window sidewalls 810 and 811 extend rearward perpendicularly from window front face 808, the first window sidewall 810 forming a first angle 840 with window front face 808 and the second window sidewall 810 forming a second angle 842 with window front face 808. In the example of FIG. 9, lighting module 8000, both first angle 840 and second angle 842 are 90°, however first angle 840 and second angle 842 may also be greater or less than 90° in other examples. As a further example, in lighting module 8002, first and second window sidewalls 860 and 861 extend rearward perpendicularly from window front face 858, the first window sidewall 860 forming a first angle 890 with window front face 858 and the second window sidewall 860 forming a second angle 892 with window front face 858. In the example illustrated in FIG. 9 lighting module 8002, first angle 890 is 90° and second angle 892 is greater than 90°. In this manner, in the case where multiple lighting modules are arranged side by side, window sidewalls adjacent to window sidewalls of an adjacent lighting module may extend rearward from the window front face at an angle of 90°. In contrast, window sidewalls that are positioned at an outer perimeter of multiple side by side lighting modules and that are not adjacent to window sidewalls of neighboring adjacent lighting modules may extend rearward from its corresponding window front face at an angle greater than 90°. In this manner, the uniformity of emitted light between edges of adjacent lighting modules in an arrangement of multiple side by side lighting modules, and the uniformity of emitted light at the perimeter edges of an arrangement multiple side by side lighting modules may be enhanced as compared to conventional lighting modules.

Furthermore, window flanges 820 and 870 of side by side lighting modules 8000 and 8002 may extend rearward beyond surfaces 826 and 876 respectively, where the respective array of light-emitting elements 806 and 866 are mounted. As an example, surfaces 826 and 876 may be printed circuit boards. In this manner, light may be emitted unobstructed through first and second window sidewalls 810 and 811, and 860 and 861, and window front faces 808 and 858 of lighting modules 8000 and 8002 so that the uniformity of emitted light at the perimeter edges of an arrangement multiple side by side lighting modules may be enhanced as compared to conventional lighting modules.

Further still, first and second window sidewalls 810 and 811, and 860 and 861 may meet window front faces 808 and 858 respectively, at window edges 812 and 813, and 862 and 863, respectively. As described above for lighting module 100 in FIG. 1, window edges 812, 813, 862, and 863 may be sharp and right-angled, beveled, rounded, or be shaped to have another non-flat contour.

Further still, first and second window sidewalls 810 and 811, and 860 and 861 may extend rearward flushly and substantially in the same plane as window frame sidewalls 818 and 868 respectively, and the housing sidewalls 803 and 853 respectively so that when lighting modules 8000 and 8002 are positioned side by side, gap 850 may be reduced in size as compared with conventional lighting modules so that the uniformity of emitted light at the perimeter edges of an arrangement multiple side by side lighting modules may be enhanced as compared to conventional lighting modules.

Turning now to FIG. 10, it illustrates a frontal view of another example lighting module 1000 comprising an edge weighted linear array of twenty-seven light-emitting elements (e.g., LEDs) contained within a housing 1010. Lighting module 1000 may further comprise a window frame 1016 mounted at a front side of the housing 1010, a window 1020, and a plurality of fasteners 1030 for fixing the window frame 1016 to housing 1010. Housing 1010 and window frame 1016 may be manufactured from a rigid material such as metal, metal alloy, plastic, or another material. The light-emitting elements may be mounted on a substrate (not shown), such as a PCB, and the front face of the substrate may have a reflective coating or surface such that light irradiated from the light-emitting elements onto the substrate front face is reflected towards the window.

Window 1020 may be transparent to light such as visible light and/or UV light. Window 1020 may thus be constructed from glass, plastic, or another transparent material. Window 1020 may be positioned approximately centrally with respect to the widthwise dimension of the window frame 1016 and a length of window 1020 may span the length of the front plane and the window frame 1016 of the housing 1010. Furthermore, window 1020 may be mounted so that its front face (e.g., 708 in FIG. 7) is flush with the window frame 1016 of the housing 1010, and so that window sidewalls 1086 are flush with the housing sidewalls (e.g., 738 in FIG. 7) and window frame sidewalls (e.g., 718 in FIG. 7). In other words, window sidewalls, housing sidewalls, and window frame sidewalls may all be aligned in the same plane. Window 1020 may serve as a transparent cover for an array of light-emitting elements contained within the housing, wherein light irradiated from the array is transmitted through window 1020 (e.g., through window front face and window sidewalls) to a target surface, where for example, a curing reaction may be driven.

The array of light-emitting elements may comprise an edge weighted linear array of light-emitting elements, as shown in FIG. 10. The linear array of light-emitting elements may be recessed under and approximately centered below window 1020 with respect to the lengthwise and widthwise dimensions of the window. Centering the linear array of light-emitting elements below the window 1020 may help to prevent irradiated light from being blocked by the lengthwise edges of the window where the window meets the window frame, and may aid in enhancing the uniformity of emitted light.

The edge weighted linear array may comprise a middle portion 1052 between two end portions 1062. Middle portion 1052 comprises twenty-one evenly spaced light-emitting elements 1050 distributed with a first spacing 1054, while end portions 1062 each comprise two light-emitting elements 1060 with a second spacing 1064.

Furthermore, lighting module 1000 may comprise a third spacing 1068 between end portions 1062 and middle portion 1052, wherein the third spacing 1068 is smaller than the first spacing 1054 and larger than the second spacing 1064. Further still, lighting module 1000 may comprise a fourth spacing 1074 between the end portions 1062 and middle portions 1052.

The edge weighted spacing illustrated in FIG. 10 is an example of an edge weighted linear array of light-emitting elements, and is not meant to be limiting. For example, edge weighted linear arrays of light-emitting elements may possess fewer or more than the twenty-seven LEDs illustrated in FIG. 10. Furthermore, the middle portion of edge weighted linear arrays may comprise a larger or smaller number of LEDs and end portions may comprise a smaller or larger number of LEDs. Further still, the first spacing between light-emitting elements in the middle portion may be larger or smaller than the first spacing 1054, the second spacing between light-emitting elements in the end portions may be larger or smaller than second spacing 1064, and the third spacing between the middle and end portions may be larger or smaller than third spacing 1068. However, edge weighted spacing implies that the second spacing between light-emitting elements in the end portions is smaller than the first spacing between light-emitting elements in the middle portion.

The first and last light-emitting elements in the edge weighted linear array may be positioned directly adjacent to the window sidewalls 1086 of the window 1020. In this manner, the edge weighted linear array of light-emitting elements may span the length of window 1020 and window frame 1016 of housing 1010. As illustrated in FIG. 10, the window sidewalls 1086 may have a thickness wherein the distance from the first or last light-emitting element of the linear array to the external surface of the corresponding window sidewall may be one half or less the first spacing between middle portion light-emitting elements. In some examples a gap 1082 between the window sidewalls and the first and last light-emitting elements in the linear array may exist. Gap 1082 may allow for tolerance stackup and assembly of the lighting modules.

In this manner, the lighting modules 100, 700, 8000 and 8002 may further comprise an edge weighted linear array of light-emitting elements as described in FIG. 10. A lighting module comprising an edge weighted linear array of light-emitting elements may further aid in enhancing a uniformity of light emitted from the lighting module.

The lighting module 1000 may further comprise coupling optics or lensing elements (not shown) positioned between the linear array of light-emitting elements and the window. Coupling optics may serve to at least reflect, refract, collimate and/or diffract irradiated light from the linear array. Coupling optics may also be integrated with window 1020. For example, a diffuser or diffracting layer may be etched or laminated onto the back surface of window 1020 that faces the linear array. Further still, coupling optics may also be integrated into the front face of window 1020 that faces the target surface.

Turning now to FIG. 11, it illustrates a partial frontal view of two lighting modules 1110, 1120 arranged side by side. Lighting modules 1110 and 1120 may each be identical to lighting module 1000. Thus, lighting modules 1110, 1120 may each comprise an edge weighted linear array of light-emitting elements. Each linear array comprises light-emitting elements 1050 distributed with a first spacing 1054 in a middle portion, and light-emitting elements 1060 distributed with a second spacing 1064 in end portions. Furthermore, lighting modules 1110 and 1120 comprise a third spacing 1068 and a fourth spacing 1074 between light-emitting elements 1050, 1060 of the middle and end portions respectively. Third spacing 1068 may be larger than second spacing 1064 and smaller than first spacing 1054.

Furthermore, first and last light-emitting elements in the end portions of lighting modules 1120 and 1110 respectively are positioned adjacent to window sidewalls 1086, wherein the window sidewalls 1086 span the length of the front plane of each lighting module housing. Positioning the first and last light-emitting elements in the linear arrays adjacent to window sidewalls 1086 may allow lighting modules 1120 and 1110 to irradiate light across the entire length of the window and also through window sidewalls 1086. Positioning the first and last light-emitting elements in the linear arrays adjacent to window sidewalls 1086 may comprise positioning the first and last light-emitting elements wherein there may be a small gap 1082 between the window sidewalls and the first and last light-emitting elements respectively.

Further still, the window sidewalls 1086 are flush with the sidewalls of the housings of lighting modules 1120 and 1110, the window and housing sidewalls extending backward perpendicularly from the front plane of the housing. Aligning the window sidewalls to be flush with the housing sidewalls may reduce spacing between and may maintain continuity of irradiated light across multiple lighting modules arranged side by side.

In this manner, the total distance from the last light-emitting element of a linear array of lighting module 1120 to the first light-emitting element of lighting module 1110 when positioned side by side may be the same or less than the first spacing between middle portion light-emitting elements. Accordingly, for a single lighting module, the distance from the last light-emitting element of the linear array to the external surface of the corresponding window sidewall may be one half or less the first spacing between middle portion light-emitting elements. Thus, light irradiated from lighting modules 1120 and 1110 arranged side by side may be more uniform when the lighting modules comprise wrap around windows with transparent window sidewalls 1086 and an edge weighted linear array of light-emitting elements as compared to light irradiated from conventional lighting modules arranged side by side. Furthermore, edge weighting the linear array of light-emitting elements may increase the useable length of light output and may increase the uniformity of emitted light from each individual lighting module.

In this manner, a lighting module may comprise: a window casing; a window mounted at a window casing front face, wherein a window front face spans a length of the window casing front face, and the window front face is flush with the window casing front face; and an array of light-emitting elements positioned behind the window casing to emit light through the window. The lighting module may further comprise a window frame, wherein the window front face is flush with a window frame front side. The window casing may comprise a window frame, and the window front face may be flush with a window frame front side. Furthermore, first and second window sidewalls may extend rearward from left and right edges of the window front face, respectively, and rearward ends of the first and second window sidewalls may be flush with left and right window casing sidewalls, respectively. Further still, the first and second window sidewalls may be flush with the left and right window casing sidewalls, respectively. Further still, the first and second window sidewalls may be flush with left and right window frame sidewalls, respectively. Further still, the rearward ends of the first and second window sidewalls may extend rearward from the window beyond the array of light-emitting elements.

The first and second window sidewalls may extend rearwards from the left and right edges of the window front face at first and second angles, respectively, and one of the first and second angles may be 90°. Furthermore, the first and second window sidewalls may extend rearwards from the left and right edges of the window front face at first and second angles, respectively, and one of the first and second angles may be greater than 90°. Further still, the first and second window sidewalls may extend rearwards from the left and right edges of the window front face at first and second angles, respectively, and the first and second angles may be greater than 90°. Further still, the window casing front side and the window front face may be flushly convex or flushly concave surfaces.

The array of light-emitting elements may comprise a linear array of light-emitting elements, the linear array of light-emitting elements comprising a middle portion in between two end portions, wherein: the middle portion may comprise a plurality of light-emitting elements distributed over the middle portion with a first, larger, spacing throughout the middle portion; and each of the two end portions may comprise a plurality of light-emitting elements distributed over the two end portions with a second, smaller, spacing throughout each of the two end portions. A third spacing between the middle portion and each of the two end portions may be greater than the second spacing and less than the first spacing. The plurality of light-emitting elements in the middle portion may be supplied with a first, larger, drive current; and the plurality of light-emitting elements in the two end portions may be supplied with a second, smaller, drive current.

Referring now to FIG. 12, it illustrates a block diagram for an example configuration of lighting system 1200. In one example, lighting system 1200 may comprise a light-emitting subsystem 1212, a controller 1214, a power source 1216 and a cooling subsystem 1218. The light-emitting subsystem 1212 may comprise a plurality of semiconductor devices 1219. The plurality of semiconductor devices 1219 may be a linear array 1220 of light-emitting elements such as a linear array of LED devices, for example. Semiconductor devices may provide radiant output 1224. The radiant output 1224 may be directed to a workpiece 1226 located at a fixed plane from lighting system 1200. Furthermore, the linear array of light-emitting elements may be an edge weighted linear array of light-emitting elements, wherein one or more methods are employed to increase the useable length of light output at workpiece 1226. For example, one or more of edge weighted spacing, lensing (e.g. providing coupling optics) of individual light-emitting elements, providing individual light-emitting elements of different intensity, and supplying differential current to individual LEDs may be employed.

The radiant output 1224 may be directed to the workpiece 1226 via coupling optics 1230. The coupling optics 1230, if used, may be variously implemented. As an example, the coupling optics may include one or more layers, materials or other structures interposed between the semiconductor devices 1219 and window 1264, and providing radiant output 1224 to surfaces of the workpiece 1226. As an example, the coupling optics 1230 may include a micro-lens array to enhance collection, condensing, collimation or otherwise the quality or effective quantity of the radiant output 1224. As another example, the coupling optics 1230 may include a micro-reflector array. In employing such a micro-reflector array, each semiconductor device providing radiant output 1224 may be disposed in a respective micro-reflector, on a one-to-one basis. As another example, a linear array of semiconductor devices 1220 providing radiant output 24 and 25 may be disposed in macro-reflectors, on a many-to-one basis. In this manner, coupling optics 1230 may include both micro-reflector arrays, wherein each semiconductor device is disposed on a one-to-one basis in a respective micro-reflector, and macro-reflectors wherein the quantity and/or quality of the radiant output 1224 from the semiconductor devices is further enhanced by macro-reflectors.

Each of the layers, materials or other structure of coupling optics 1230 may have a selected index of refraction. By properly selecting each index of refraction, reflection at interfaces between layers, materials and other structures in the path of the radiant output 1224 may be selectively controlled. As an example, by controlling differences in such indexes of refraction at a selected interface, for example window 1264, disposed between the semiconductor devices to the workpiece 1226, reflection at that interface may be reduced or increased so as to enhance the transmission of radiant output at that interface for ultimate delivery to the workpiece 1226. For example, the coupling optics may include a dichroic reflector where certain wavelengths of incident light are absorbed, while others are reflected and focused to the surface of workpiece 1226.

The coupling optics 1230 may be employed for various purposes. Example purposes include, among others, to protect the semiconductor devices 1219, to retain cooling fluid associated with the cooling subsystem 1218, to collect, condense and/or collimate the radiant output 1224, or for other purposes, alone or in combination. As a further example, the lighting system 1200 may employ coupling optics 1230 so as to enhance the effective quality, uniformity, or quantity of the radiant output 1224, particularly as delivered to the workpiece 1226.

As described above for lighting module 100 in FIG. 1, window 1264 may be a wrap around window similar to window 104 and may comprise a front window front face 108 spanning a front plane length and first and second window sidewalls 110 and 111 and extending rearwards from the first and second widthwise window edges 112 and 113 of the window front face 108. The window frame 114 may comprise a window frame front face 116 and window frame sidewalls 118. As shown in FIGS. 1-2, second window sidewall 111 may extend rearward perpendicularly from window front face 108. Furthermore edges 112 and 113 may be sharp and right-angled.

Window front face 108 may be flush and parallel with window frame front face 116, and second window sidewall 111 may be flush with and parallel with window frame sidewall 118. First and second window sidewalls may further comprise window flanges 120, the window flanges extending rearwards beyond the array of light-emitting elements 106. For example, as shown in FIG. 3, when window 104 is mounted to window frame 114 via opening 122, the rear edge of flange 120 extends beyond the array of light-emitting elements 106 in rearward direction. In this manner, light emitted from the array of light-emitting elements 106 may be irradiated through the front face 108 and through first and second window sidewalls 110 and 111. Because light emitted from the array of light-emitting elements 106 is emitted through the first and second window sidewalls 110 and 111, the uniformity of irradiated light, particularly at the edges of lighting module 100 near first and second widthwise edges 112 and 113, may be enhanced as compared to lighting modules emitting light through only a flat front plane of a window. Accordingly, the array of light-emitting elements 106 may be positioned within the housing 102 and aligned with to emit light through the window front face 108 as well as the first and second window sidewalls 110 and 111. Furthermore, the array of light-emitting elements 106 may emit light through the window 104 toward a substrate comprising a light-curable material Selected of the plurality of semiconductor devices 1219 may be coupled to the controller 1214 via coupling electronics 1222, so as to provide data to the controller 1214. As described further below, the controller 1214 may also be implemented to control such data-providing semiconductor devices, e.g., via the coupling electronics 1222. The controller 1214 may be connected to, and may be implemented to control, the power source 1216, and the cooling subsystem 1218. For example, the controller may supply a larger drive current to light-emitting elements distributed in the middle portion of linear array 1220 and a smaller drive current to light-emitting elements distributed in the end portions of linear array 1220 in order to increase the useable length of light irradiated at workpiece 1226. Moreover, the controller 1214 may receive data from power source 1216 and cooling subsystem 1218. In one example, the irradiance at one or more locations at the workpiece 1226 surface may be detected by sensors and transmitted to controller 1214 in a feedback control scheme. In a further example, controller 1214 may communicate with a controller of another lighting system (not shown in FIG. 12) to coordinate control of both lighting systems. For example, controllers 1214 of multiple lighting systems may operate in a master-slave cascading control algorithm, where the setpoint of one of the controllers is set by the output of the other controller. Other control strategies for operation of lighting system 10 in conjunction with another lighting system may also be used. As another example, controllers 1214 for multiple lighting systems arranged side by side may control lighting systems in an identical manner for increasing uniformity of irradiated light across multiple lighting systems.

In addition to the power source 1216, cooling subsystem 1218, and light-emitting subsystem 1212, the controller 1214 may also be connected to, and implemented to control internal element 1232, and external element 1234. Element 1232, as shown, may be internal to the lighting system 1200, while element 1234, as shown, may be external to the lighting system 1210, but may be associated with the workpiece 1226 (e.g., handling, cooling or other external equipment) or may be otherwise related to a photoreaction (e.g. curing) that lighting system 1210 supports.

The data received by the controller 1214 from one or more of the power source 1216, the cooling subsystem 1218, the light-emitting subsystem 1212, and/or elements 1232 and 1234, may be of various types. As an example the data may be representative of one or more characteristics associated with coupled semiconductor devices 1219. As another example, the data may be representative of one or more characteristics associated with the respective light-emitting subsystem 1212, power source 1216, cooling subsystem 1218, internal element 1232, and external element 1234 providing the data. As still another example, the data may be representative of one or more characteristics associated with the workpiece 1226 (e.g., representative of the radiant output energy or spectral component(s) directed to the workpiece). Moreover, the data may be representative of some combination of these characteristics.

The controller 1214, in receipt of any such data, may be implemented to respond to that data. For example, responsive to such data from any such component, the controller 1214 may be implemented to control one or more of the power source 1216, cooling subsystem 1218, light-emitting subsystem 1212 (including one or more such coupled semiconductor devices), and/or the elements 32 and 34. As an example, responsive to data from the light-emitting subsystem indicating that the light energy is insufficient at one or more points associated with the workpiece, the controller 1214 may be implemented to either (a) increase the power source's supply of power to one or more of the semiconductor devices, (b) increase cooling of the light-emitting subsystem via the cooling subsystem 1218 (e.g., certain light-emitting devices, if cooled, provide greater radiant output), (c) increase the time during which the power is supplied to such devices, or (d) a combination of the above.

Individual semiconductor devices 1219 (e.g., LED devices) of the light-emitting subsystem 1212 may be controlled independently by controller 1214. For example, controller 1214 may control a first group of one or more individual LED devices to emit light of a first intensity, wavelength, and the like, while controlling a second group of one or more individual LED devices to emit light of a different intensity, wavelength, and the like. The first group of one or more individual LED devices may be within the same linear array 1220 of semiconductor devices, or may be from more than one linear array of semiconductor devices 1220 from multiple lighting systems 1200. Linear array 1220 of semiconductor device may also be controlled independently by controller 1214 from other linear arrays of semiconductor devices in other lighting systems. For example, the semiconductor devices of a first linear array may be controlled to emit light of a first intensity, wavelength, and the like, while those of a second linear array in another lighting system may be controlled to emit light of a second intensity, wavelength, and the like.

As a further example, under a first set of conditions (e.g. for a specific workpiece, photoreaction, and/or set of operating conditions) controller 1214 may operate lighting system 1200 to implement a first control strategy, whereas under a second set of conditions (e.g. for a specific workpiece, photoreaction, and/or set of operating conditions) controller 1214 may operate lighting system 1200 to implement a second control strategy. As described above, the first control strategy may include operating a first group of one or more individual semiconductor devices (e.g., LED devices) to emit light of a first intensity, wavelength, and the like, while the second control strategy may include operating a second group of one or more individual LED devices to emit light of a second intensity, wavelength, and the like. The first group of LED devices may be the same group of LED devices as the second group, and may span one or more arrays of LED devices, or may be a different group of LED devices from the second group, but the different group of LED devices may include a subset of one or more LED devices from the second group.

The cooling subsystem 1218 may be implemented to manage the thermal behavior of the light-emitting subsystem 1212. For example, the cooling subsystem 1218 may provide for cooling of light-emitting subsystem 1212, and more specifically, the semiconductor devices 1219. The cooling subsystem 1218 may also be implemented to cool the workpiece 1226 and/or the space between the workpiece 1226 and the lighting system 1200 (e.g., the light-emitting subsystem 1212). For example, cooling subsystem 1218 may comprise an air or other fluid (e.g., water) cooling system. Cooling subsystem 1218 may also include cooling elements such as cooling fins attached to the semiconductor devices 1219, or linear array 1220 thereof, or to the coupling optics 1230. For example, cooling subsystem may include blowing cooling air over the coupling optics 1230, wherein the coupling optics 1230 are equipped with external fins to enhance heat transfer.

The lighting system 1200 may be used for various applications. Examples include, without limitation, curing applications ranging from ink printing to the fabrication of DVDs and lithography. The applications in which the lighting system 1200 may be employed can have associated operating parameters. That is, an application may have associated operating parameters as follows: provision of one or more levels of radiant power, at one or more wavelengths, applied over one or more periods of time. In order to properly accomplish the photoreaction associated with the application, optical power may be delivered at or near the workpiece 1226 at or above one or more predetermined levels of one or a plurality of these parameters (and/or for a certain time, times or range of times).

In order to follow an intended application's parameters, the semiconductor devices 1219 providing radiant output 1224 may be operated in accordance with various characteristics associated with the application's parameters, e.g., temperature, spectral distribution and radiant power. At the same time, the semiconductor devices 1219 may have certain operating specifications, which may be associated with the semiconductor devices' fabrication and, among other things, may be followed in order to preclude destruction and/or forestall degradation of the devices. Other components of the lighting system 1200 may also have associated operating specifications. These specifications may include ranges (e.g., maximum and minimum) for operating temperatures and applied electrical power, among other parameter specifications.

Accordingly, the lighting system 1200 may support monitoring of the application's parameters. In addition, the lighting system 1200 may provide for monitoring of semiconductor devices 1219, including their respective characteristics and specifications. Moreover, the lighting system 1200 may also provide for monitoring of selected other components of the lighting system 1200, including its characteristics and specifications.

Providing such monitoring may enable verification of the system's proper operation so that operation of lighting system 1200 may be reliably evaluated. For example, lighting system 1200 may be operating improperly with respect to one or more of the application's parameters (e.g. temperature, spectral distribution, radiant power, and the like), any component's characteristics associated with such parameters and/or any component's respective operating specifications. The provision of monitoring may be responsive and carried out in accordance with the data received by the controller 1214 from one or more of the system's components.

Monitoring may also support control of the system's operation. For example, a control strategy may be implemented via the controller 1214, the controller 1214 receiving and being responsive to data from one or more system components. This control strategy, as described above, may be implemented directly (e.g., by controlling a component through control signals directed to the component, based on data respecting that components operation) or indirectly (e.g., by controlling a component's operation through control signals directed to adjust operation of other components). As an example, a semiconductor device's radiant output may be adjusted indirectly through control signals directed to the power source 1216 that adjust power applied to the light-emitting subsystem 1212 and/or through control signals directed to the cooling subsystem 1218 that adjust cooling applied to the light-emitting subsystem 1212.

Control strategies may be employed to enable and/or enhance the system's proper operation and/or performance of the application. In a more specific example, control may also be employed to enable and/or enhance balance between the linear array's radiant output and its operating temperature, so as, e.g., to preclude heating the semiconductor devices 1219 beyond their specifications while also directing sufficient radiant energy to the workpiece 1226, for example, to carry out a photoreaction of the application.

In some applications, high radiant power may be delivered to the workpiece 1226. Accordingly, the light-emitting subsystem 1212 may be implemented using a linear array of light-emitting semiconductor devices 1220. For example, the light-emitting subsystem 1212 may be implemented using a high-density, light-emitting diode (LED) array. Although LED arrays may be used and are described in detail herein, it is understood that the semiconductor devices 1219, and linear arrays 1220 thereof, may be implemented using other light-emitting technologies without departing from the principles of the invention; examples of other light-emitting technologies include, without limitation, organic LEDs, laser diodes, other semiconductor lasers.

In this manner, a lighting system may comprise: a power supply; a cooling subsystem; a light-emitting subsystem comprising, a window casing; a window frame mounted at a window casing front side; a window mounted at a front plane of the window frame, the window comprising a window front face spanning a front plane length, wherein the window front face is flush with a window frame front side, and first and second window sidewalls extending rearwards from first and second edges of the window front face at first and second angles, respectively; a linear array of light-emitting elements within the window casing, the linear array aligned with and emitting light through a window front plane and through the first and second window sidewalls, wherein: window sidewalls at the first and second edges of the window front face are aligned flush with window casing sidewalls, the window sidewalls extending perpendicularly back from the front plane, the linear array of light-emitting elements comprises a middle portion in between two end portions, and a controller, including instructions executable to supply a first, larger, drive current to each of a plurality of light-emitting elements in the middle portion, and supply a second, smaller, drive current to each of a plurality of light-emitting elements in the two end portions.

In this manner a lighting system may comprise a power supply, a cooling subsystem, a light-emitting subsystem, and a linear array of light-emitting elements within the housing. The light-emitting subsystem may comprise a housing, a window frame mounted at a front side of the housing, and a window mounted at a front plane of the window frame. The window may comprise a window front face spanning a front plane length and first and second window sidewalls extending rearwards from first and second edges of the window front face at first and second angles, respectively. The linear array of light-emitting elements may be aligned with and emit light through a window front plane and through the first and second window sidewalls, wherein first and last light-emitting elements of the linear array are positioned adjacent to the widthwise edges of the window front face, window sidewalls at the widthwise edges of the window front face are aligned flush with housing sidewalls, the window sidewalls extending perpendicularly back from the front plane, and the linear array of light-emitting elements comprises a middle portion in between two end portions. Furthermore, the linear array may have only a single row of elements, wherein the middle portion comprises a plurality of light-emitting elements distributed over the middle portion with a first spacing throughout the middle portion, and each of the end portions comprise a plurality of light-emitting elements distributed over the end portion with a second spacing throughout each end portion, the first spacing being greater than the second spacing. The lighting system may further comprise a controller, including instructions executable to irradiate light from the light-emitting elements distributed over the middle portion having a first irradiance, and to irradiate light from light-emitting elements distributed over the end portions having a second irradiance, wherein the first irradiance is greater than the second irradiance.

Turning now to FIG. 13, it illustrates a flow chart for an example method 1300 of irradiating a target surface. Method 1300 begins at 1310 where the dimensions of the target surface to be irradiated are determined. The target surface may comprise a portion of a surface or an entire surface. The target surface may further comprise a portion of a surface or object to be uniformly irradiated. Continuing at 1320, the number of lighting modules to be used is determined. The lighting modules may each comprise a wrap around window and/or an edge weighted linear array of light-emitting elements for increasing the useable length of emitted light and enhancing the uniformity of the emitted light. For example, one or a plurality of edge weighed linear array lighting modules arranged side by side may be used to irradiate the target surface. The number of lighting modules may be determined based one or more factors including the dimensions of the target surface to be irradiated, the irradiance pattern of the one or plurality of lighting modules, the dimension of the lighting modules, the power supplied to the lighting modules, and the target surface exposure time, among other factors. For example if the length of the target surface is very long, multiple lighting modules arranged side by side may be used to irradiate the entire length of the target surface. Next, method 1300 continues at 1330 where the array of lighting modules is arranged.

Method 1300 continues at 1340 where it is determined if irradiance uniformity is to be enhanced. For example, based on 1320 and 1330, it may be determined that irradiance uniformity is to be enhanced in order to irradiate a target surface with a predetermined irradiance uniformity within a predetermined irradiance exposure time. For example, a predetermined irradiance exposure time may correspond to a specified cure rate or curing time of a curing reaction at the target surface that is to be driven by the irradiated light. As another example, irradiation uniformity may be enhanced to provide uniform irradiance above a minimum irradiance threshold.

If it is determined that irradiance uniformity is to be enhanced, method 1300 continues at 1350, where the irradiance of middle portion light-emitting elements of the one or more edge weighted linear array lighting modules may be boosted. For example, boosting may comprise one or more of using higher intensity light-emitting elements (e.g., LEDs) in the middle portion of edge weighted the linear array lighting modules, using lower intensity light-emitting elements in the end portions of edge weighted the linear array lighting modules, integrating lens elements or other optical elements with the linear array light-emitting elements, or supplying light-emitting elements individually with different drive currents. For example, boosting irradiance of the middle portion light-emitting elements may comprise supplying additional drive current to the middle portion light-emitting elements, or supplying lower drive current to the end portion light-emitting elements. As another example, boosting irradiance of the middle portion light-emitting elements may comprise lensing the middle portion light-emitting elements to collimate irradiated light therefrom and/or supplying additional drive current to the middle portion light-emitting elements. Other methods and combinations of boosting the irradiance of middle portion light-emitting elements may be used to enhance irradiance uniformity.

If the lighting modules do not comprise an edge weighted linear array of light-emitting elements, method 1300 may not execute 1340 and 1350 and may continue at 1360 from 1330.

Next, method 1300 continues at 1360 where one or a plurality of lighting modules may be arranged side by side opposite a target surface at a fixed plane. The distance of the fixed plane from the one or more lighting modules may be determined based on one or more of 1320, 1330, 1340, and 1350 wherein arranging the target surface at the fixed plane opposite the one or more lighting modules can achieve uniform irradiance of the target surface.

Method 1300 continues at 1370 where power is supplied to the one or plurality of edge weighted linear array lighting modules to irradiate the target surface. Supplying power to the one or plurality of edge weighted linear array lighting modules may include supplying additional drive current to the middle portion light-emitting elements, or supplying lower drive current to the end portion light-emitting elements in order to enhance irradiance uniformity as in 1340 and 1350. Supplying power to the one or plurality of edge weighted linear array lighting modules may further comprise supplying power for a predetermined length of time or as prescribed by a controller control scheme. For example, one or more controllers (e.g., 1214) may supply power to the one or plurality of edge weighted linear array lighting modules to irradiate the target surface according to a feedback control scheme. Other examples of control schemes are described above in reference to FIG. 12. After 1370, method 1300 ends.

In this manner, a method of irradiating light may comprise irradiating light from an array of lighting modules, each of the array of lighting modules comprising: a window casing; a window mounted at a window casing front side, wherein the window comprises a window front face spanning a length of the window casing front side, and wherein the window front face is flush with the window casing front side; first and second window sidewalls extending rearwards from left and right edges of the window front face, respectively; and an array of light-emitting elements positioned within the window casing to emit light through the window front face and through the first and second window sidewalls. The method may further comprise arranging adjacent lighting modules of the array of lighting modules in a side by side manner, including aligning the window front face of each of the adjacent lighting module to be coplanar. Arranging adjacent lighting modules of the array of lighting modules in a side by side manner may further include positioning the right edge of the window front face of one of the adjacent lighting modules directly adjacent to the left edge of the window front face of the other adjacent lighting module.

The first and second window sidewalls may extend rearwards from the left and right edges of the window front face at first and second angles, respectively, and one of the first and second angles may be 90°. Furthermore, the array of light-emitting elements of each of the array of lighting modules further may comprise a linear array of light-emitting elements, the linear array of light-emitting elements includes a middle portion in between two end portions, and the method may further comprise, supplying a first, larger, drive current to each of the plurality of light-emitting elements in the middle portion, and supplying a second, smaller, drive current to each of the plurality of light-emitting elements in the two end portions.

Irradiating light from the linear array of light-emitting elements may further comprise irradiating light from the plurality of light-emitting elements distributed over the middle portion having a first intensity, and irradiating light from light-emitting elements distributed over the end portions having a second intensity, wherein the first intensity is greater than the second intensity. Irradiating light from the linear array of light-emitting elements may further comprise supplying a first drive current to each of the plurality of light-emitting elements in the middle portion, and supplying a second drive current to each of the plurality of light-emitting elements in the end portions, wherein the first drive current is greater than the second drive current, and the first irradiance is greater than the second irradiance.

It will be appreciated that the configurations disclosed herein are exemplary in nature, and that these specific embodiments are not to be considered in a limiting sense, because numerous variations are possible. For example, the above embodiments can be applied to workpieces such as inks, coated surfaces, adhesives, optical fibers, cables, and ribbons. Furthermore, the lighting modules and lighting systems described above may be integrated with existing manufacturing equipment and are not designed for a specific type of light engine. As described above, any suitable light engine may be used such as a microwave-powered lamp, LED's, LED arrays, and mercury arc lamps. The subject matter of the present disclosure includes all novel and non-obvious combinations and subcombinations of the various configurations, and other features, functions, and/or properties disclosed herein.

Note that the example process flows described herein can be used with various lighting sources and lighting system configurations. The process flows described herein may represent one or more of any number of processing strategies such as continuous, batch, semi-batch, and semi-continuous processing, and the like. As such, various acts, operations, or functions illustrated may be performed in the sequence illustrated, in parallel, or in some cases omitted. Likewise, the order of processing is not necessarily called for to achieve the features and advantages of the example embodiments described herein, but is provided for ease of illustration and description. One or more of the illustrated acts or functions may be repeatedly performed depending on the particular strategy being used. It will be appreciated that the configurations and routines disclosed herein are exemplary in nature, and that these specific embodiments are not to be considered in a limiting sense, because numerous variations are possible. The subject matter of the present disclosure includes all novel and non-obvious combinations and subcombinations of the various systems and configurations, and other features, functions, and/or properties disclosed herein.

The following claims particularly point out certain combinations and subcombinations regarded as novel and non-obvious. These claims may refer to "an" element or "a first" element or the equivalent thereof. Such claims are to be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A lighting module, comprising:
a window casing;
a window mounted at a window casing front face, wherein
a window front face spans an entire length of the window casing front face, and
the window front face is flush with the window casing front face; and
an array of light-emitting elements are positioned behind the window casing to emit light through the window.

2. The lighting module of claim 1, wherein a window frame is integrated into the window casing, and wherein the window front face is flush with a window frame front side.

3. The lighting module of claim 1, wherein
the window casing comprises a window frame, and
the window front face is flush with a window frame front side.

4. The lighting module of claim 1, wherein
first and second window sidewalls extend rearward from left and right edges of the window front face, respectively, and
rearward ends of the first and second window sidewalls are flush with left and right window casing sidewalls, respectively.

5. The lighting module of claim 4, wherein the first and second window sidewalls are flush with the left and right window casing sidewalls, respectively.

6. The lighting module of claim 4, wherein the first and second window sidewalls are flush with left and right window frame sidewalls, respectively.

7. The lighting module of claim 4, wherein the rearward ends of the first and second window sidewalls extend rearward from the window beyond the array of light-emitting elements.

8. The lighting module of claim 4, wherein
the first and second window sidewalls extend rearwards from the left and right edges of the window front face at first and second angles, respectively, and
one of the first and second angles is 90°.

9. The lighting module of claim 4, wherein
the first and second window sidewalls extend rearwards from the left and right edges of the window front face at first and second angles, respectively, and
one of the first and second angles is greater than 90°.

10. The lighting module of claim 4, wherein
the first and second window sidewalls extend rearwards from the left and right edges of the window front face at first and second angles, respectively, and
the first and second angles are greater than 90°.

11. The lighting module of claim 1, wherein the array of light-emitting elements comprises a linear array of light-emitting elements, the linear array of light-emitting elements comprising a middle portion in between two end portions, wherein:

the middle portion comprises a plurality of light-emitting elements distributed over the middle portion with a first, larger, spacing throughout the middle portion; and each of the two end portions comprise a plurality of light-emitting elements distributed over the two end portions with a second, smaller, spacing throughout each of the two end portions.

12. The lighting module of claim 8, wherein a third spacing between the middle portion and each of the two end portions is greater than the second spacing and less than the first spacing.

13. The lighting module of claim 10, wherein:

the plurality of light-emitting elements in a middle portion are supplied with a first, larger drive current; and the plurality of light-emitting elements in the two end portions are supplied with a second, smaller drive current.

14. A method of irradiating light, comprising:

irradiating light from an array of lighting modules, each of the array of lighting modules comprising:

a window casing;

a window mounted at a window casing front side, wherein the window comprises a window front face spanning a length of the window casing front side, and wherein the window front face is flush with the window casing front side;

first and second window sidewalls extending rearwards from left and right edges of the window front face, respectively; and an array of light-emitting elements positioned within the window casing to emit light through the window front face and through the first and second window sidewalls.

15. The method of claim 14, further comprising arranging adjacent lighting modules of the array of lighting modules in a side by side manner, including aligning the window front face of each of the adjacent lighting modules to be coplanar.

16. The method of claim 15, wherein arranging adjacent lighting modules of the array of lighting modules in a side by side manner further includes positioning the right edge of the window front face of one of the adjacent lighting modules directly adjacent to the left edge of the window front face of the other adjacent lighting module.

17. The method of claim 14, wherein the first and second window sidewalls extend rearwards from the left and right edges of the window front face at first and second angles, respectively, and one of the first and second angles is 90°.

18. The method of claim 14, wherein the array of light-emitting elements of each of the array of lighting modules further comprises a linear array of light-emitting elements, the linear array of light-emitting elements includes a middle portion in between two end portions, the method further comprising, supplying a first, larger drive current to each of the plurality of light-emitting elements in the middle portion, and supplying a second, smaller drive current to each of the plurality of light-emitting elements in the two end portions.

19. A lighting system comprising:

a power supply;

a cooling subsystem;

a light-emitting subsystem comprising, a window casing;

a window frame mounted at a window casing front side;

a window mounted at a front plane of the window frame, the window comprising a window front face spanning a front plane length, wherein the window front face is flush with a window frame front side, and first and second window sidewalls extending rearwards from first and second edges of the window front face at first and second angles, respectively; and a linear array of light-emitting elements within the window casing, the linear array aligned with and emitting light through a window front plane and through the first and second window sidewalls, wherein:

window sidewalls at the first and second edges of the window front face are aligned flush with window casing sidewalls, the window casing sidewalls extending perpendicularly back from the front plane, and the linear array of light-emitting elements comprises a middle portion in between two end portions, and a controller, including instructions executable to supply a first, larger drive current to each of a plurality of light-emitting elements in the middle portion, and supply a second, smaller drive current to each of a plurality of light-emitting elements in the two end portions.

* * * * *